US008579665B2

(12) United States Patent
Yu et al.

(10) Patent No.: US 8,579,665 B2
(45) Date of Patent: Nov. 12, 2013

(54) POWER CONNECTOR

(75) Inventors: Wang-I Yu, Jhonghe (TW); Ya-Juan Gou, Taicang (CN); Hung-Chi Tai, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 28 days.

(21) Appl. No.: 13/331,012

(22) Filed: Dec. 20, 2011

(65) Prior Publication Data

US 2013/0109223 A1 May 2, 2013

(30) Foreign Application Priority Data

Oct. 28, 2011 (CN) ..... 2011 1 0333706

(51) Int. Cl.
*H01R 24/04* (2006.01)

(52) U.S. Cl.
USPC ..... 439/668; 439/607.35

(58) Field of Classification Search
USPC ..... 439/63, 581, 607.35–607.4, 668, 675
See application file for complete search history.

(56) References Cited

U.S. PATENT DOCUMENTS

| | | | | |
|---|---|---|---|---|
| 6,322,397 | B1 * | 11/2001 | Zhang | 439/668 |
| 6,382,999 | B1 * | 5/2002 | Mou et al. | 439/188 |
| 7,114,989 | B2 * | 10/2006 | Yin | 439/578 |
| 7,278,863 | B1 * | 10/2007 | Chen et al. | 439/79 |
| 7,338,329 | B2 * | 3/2008 | Yang | 439/675 |
| 7,445,515 | B1 * | 11/2008 | Yuan et al. | 439/668 |
| 7,901,249 | B1 * | 3/2011 | Chen | 439/607.4 |
| 7,934,960 | B1 * | 5/2011 | Zhang et al. | 439/668 |

* cited by examiner

*Primary Examiner* — Thanh Tam Le
(74) *Attorney, Agent, or Firm* — Sughrue Mion, PLLC

(57) ABSTRACT

A power connector mountable on a circuit board, includes an insulating housing, a conductive pin and a pair of spring contacts received in the insulating housing. The insulating housing defines a central channel extending therethrough along a lengthwise direction thereof, and a passageway positioned besides and communicating with the central channel. The insulating housing has a pair of heat dissipation cavities extending through the insulating housing along a longitudinal direction of the insulating housing.

18 Claims, 13 Drawing Sheets

POWER CONNECTOR

BACKGROUND OF THE INVENTION

1. Field of the Invention

The present invention relates to an electrical connector, and more particularly to a power connector mounting on a printed circuit board (PCB).

2. Description of Related Art

A conventional power connector mountable on a circuit board usually includes an insulating housing, a front shell covering a front of the insulating housing, a rear shell covering a rear of the insulating housing, a central pin received in the insulating housing, a connecting contact electrically connecting the cenral pin to the printed circuit board and a spring contact arranged besides the central pin. Obviously, such a conventional power connector does not provide a heat dissipation structure, the heat generated from the central pin will not be dissipated, which in turn weakens the signal transmission performance of the power connector.

Hence, a power connector with improved housing to resolve the above-mentioned problem is needed.

BRIEF SUMMARY OF THE INVENTION

The present invention provides a power connector mountable on a circuit board. The power connector comprises an insulating housing, a conductive pin and a pair of spring contacts received in the insulating housing. The insulating housing defines a central channel extending therethrough along a lengthwise direction thereof, and a passageway positioned besides and communicating with the central channel. The insulating housing has a pair of heat dissipation cavities extending through the insulating housing along a longitudinal direction of the insulating housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
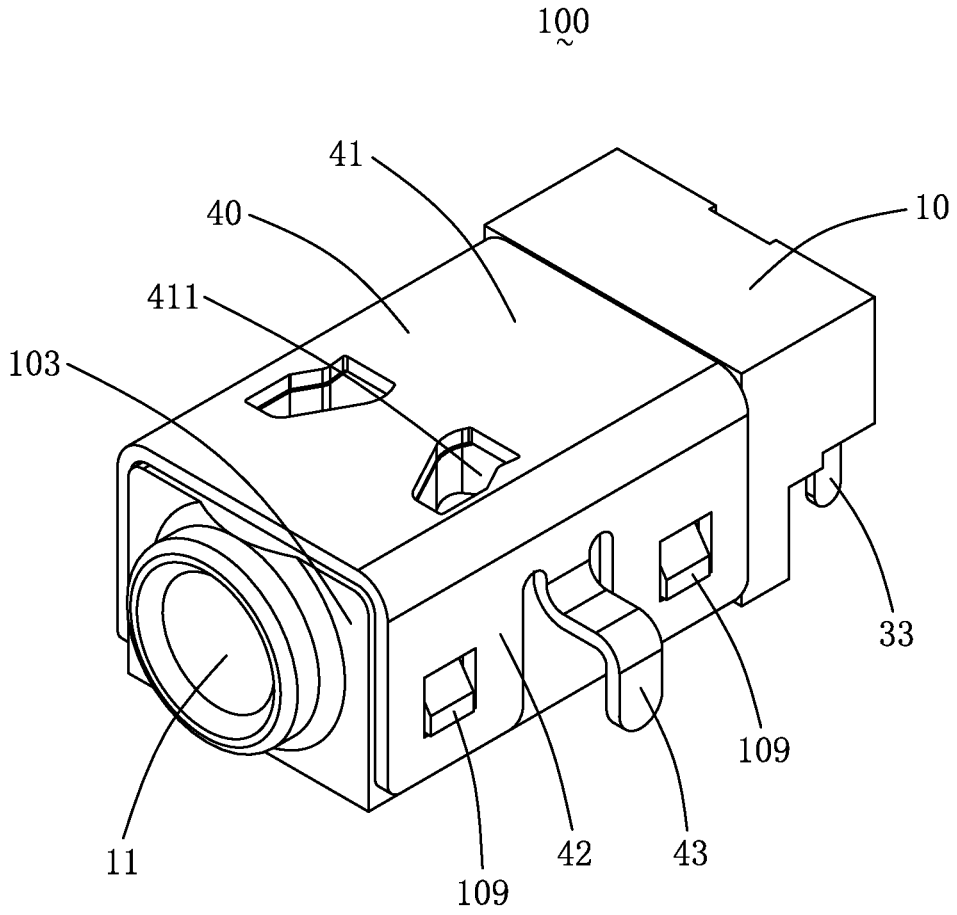
FIG. 1 is a perspective view of a power connector in accordance with the present invention.

Reference will now be made to the drawing figures to describe the embodiments of the present invention in detail. In the following description, the same drawing reference numerals are used for the same elements in different drawings.

Referring to FIGS. 1-4, a power connector 100, which is mounting onto a circuit board (not shown), in accordance with the present invention comprises an insulating housing 10 extending along a lengthwise direction, a conductive pin 20 assembled to the insulating housing 10, a pair of spring contacts 30 retained in the insulating housing 10, and a metal shell 40 covering the insulating housing 10. In the preferred embodiment, the pair of spring contacts are symmetrically arranged on opposite sides of the conductive pin 20. In other embodiments, the number, the configuration and the arrangement of the spring contact 30 are not limited.

Referring to FIGS. 3-7, the insulating housing 10 comprises a top wall 101, a bottom wall 102 opposite and parallel to the top wall 101, a mating face 103 connecting the top wall 101 and the bottom wall 102, and a rear face 104 opposite to the mating face 103 along the lengthwise direction. A pair of side walls 105, 106 are formed for connecting the top wall 101 and the bottom wall 102. The insulating housing 10 defines a central channel 11 extending along the lengthwise direction and opened from the mating face 103. A pair of passageways 12 are symmetrically arranged at opposite sides of the central channel 11 and communicate with the central channel 11. Each side wall 105, 106 provides a locking protrusion 109 therewith on an outer surface thereof. The insulating housing 10 defines a pair of heat dissipation cavities 13 extending therethrough along a longitudinal direction of the insulating housing 10. The pair of heat dissipation cavities 13 communicate with the pair of passageways 12 to thereby form a heat dissipation path through the insulating housing 10. The pair of heat dissipation cavities 13 are respectively opened from the top wall 101 and the bottom wall 102. In this preferred embodiment, two heat dissipation cavities 13 are provided. While, in other embodiments, the number of the heat dissipation cavity 13 can be changeable according to the application environment. The heat dissipation cavity 13 and corresponding communicated passageway 12 are aligned in a same line along the longitudinal direction. The insulating housing 10 also defines a pair of receiving slots 107 slotted through the bottom wall 102, from which the spring contacts 30 are inserted into the insulating housing 10. The receiving slots 107 communicate with corresponding heat dissipation cavities 13. The receiving slots 107 extend rearwards and are opened on the rear face 104. A fastening protrusion 108 is formed in the receiving slot 107 for cooperating with the spring contact 30. Details will be given hereinafter.

Figure 2:
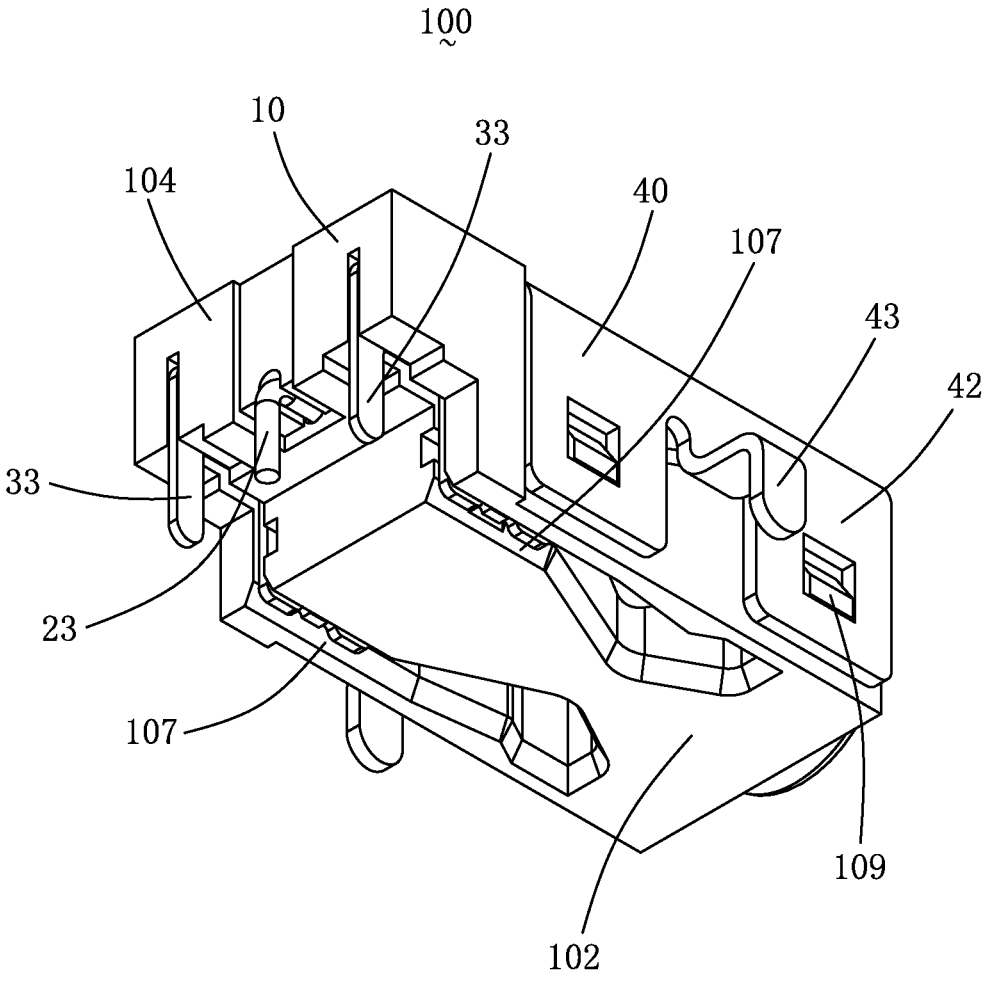
FIG. 2 is another perspective view of the power connector.
Figure 3:
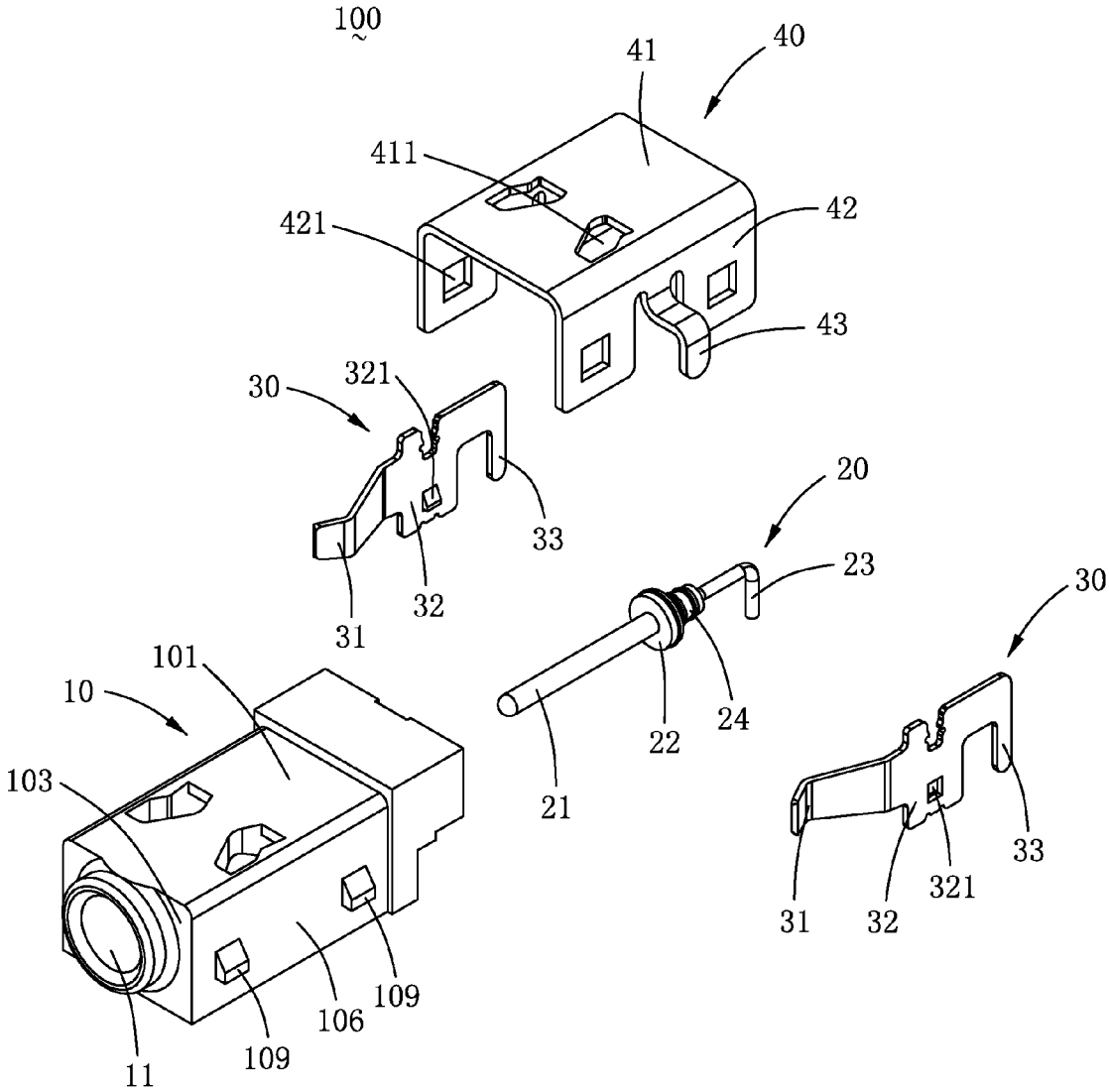
FIG. 3 is an exploded, perspective view of the power connector.
Figure 4:
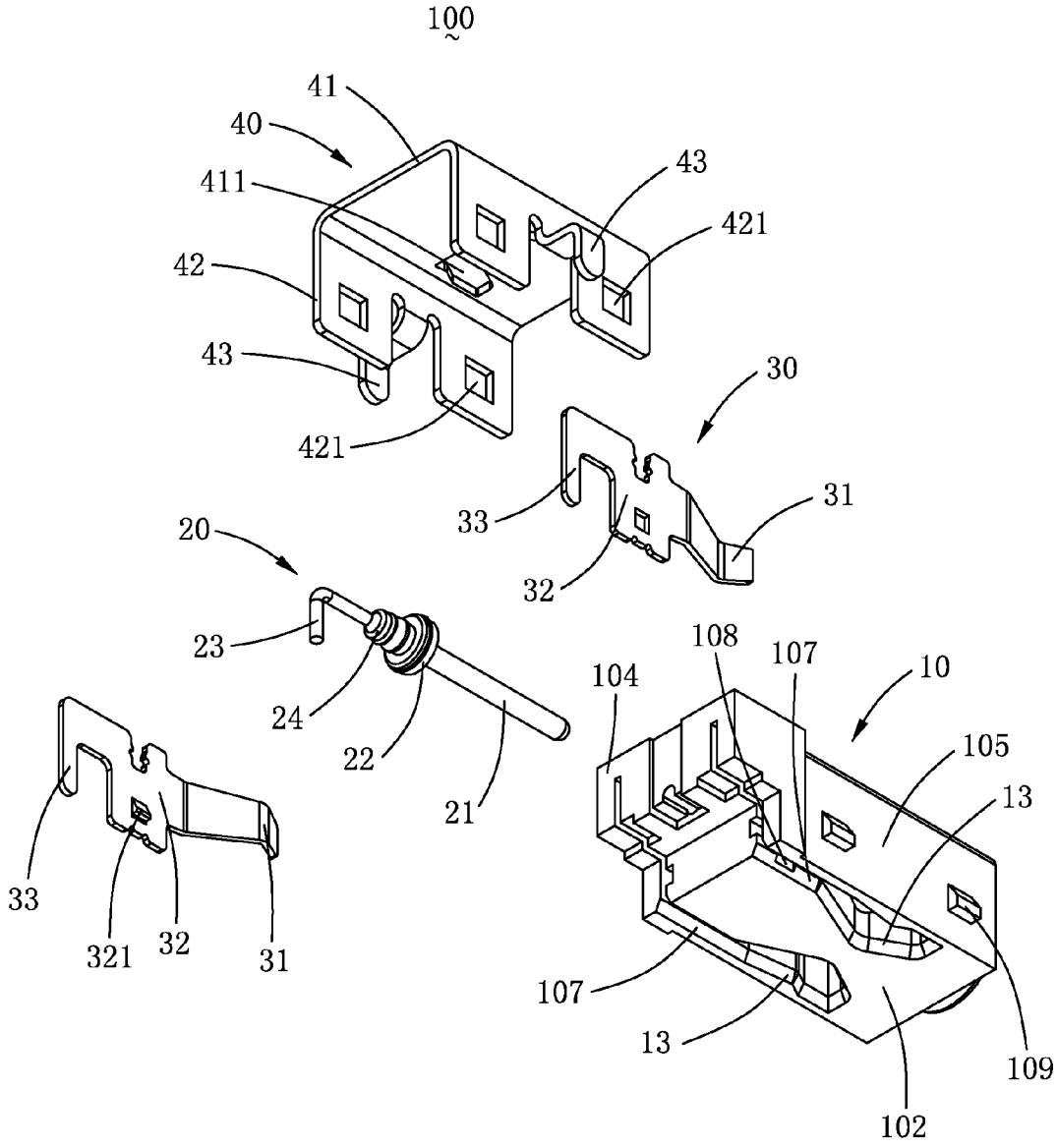
FIG. 4 is another exploded, perspective view of the power connector.
Figure 5:
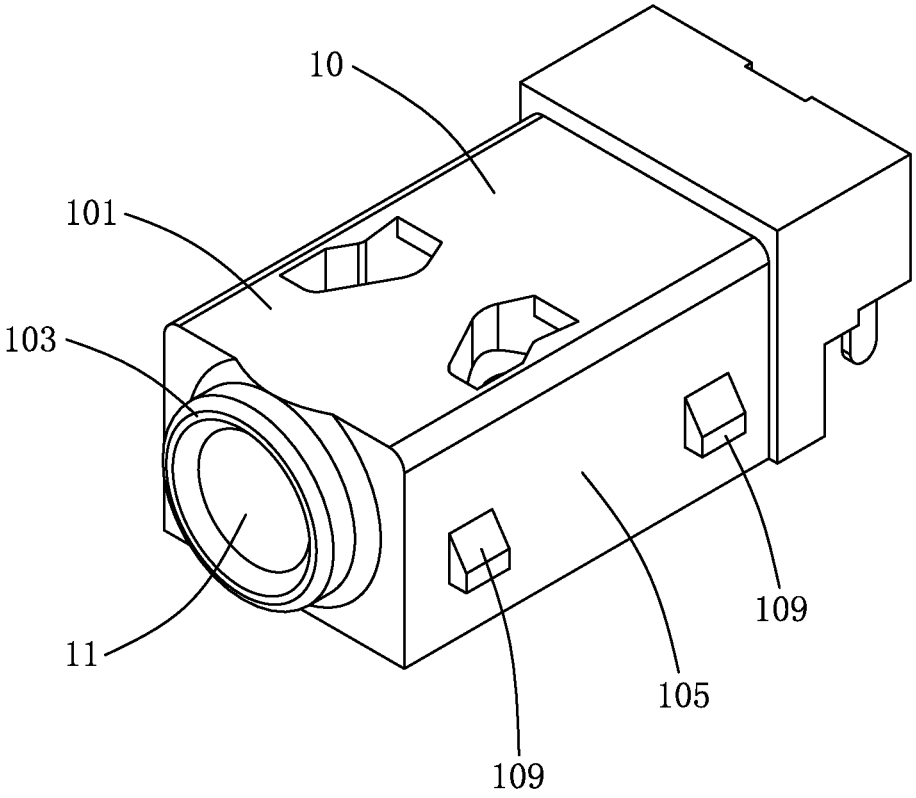
FIG. 5 is a perspective view of an insulating housing and corresponding contacts received therein.
Figure 6:
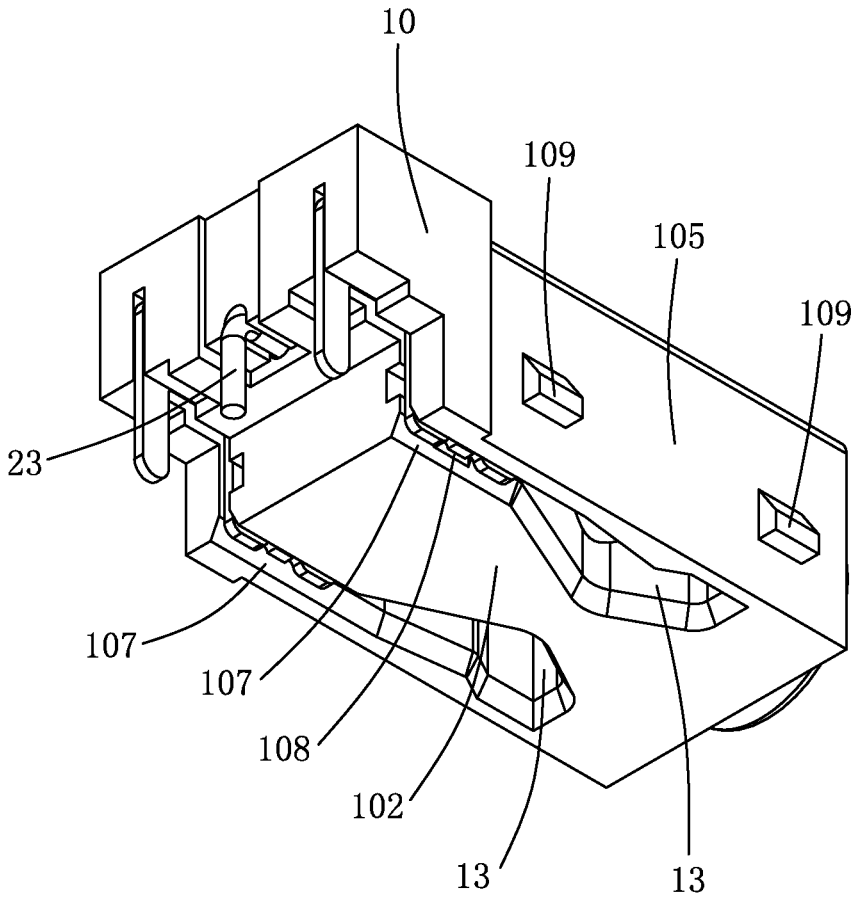
FIG. 6 is a view similar to FIG. 5 while taken from another aspect.
Figure 7:
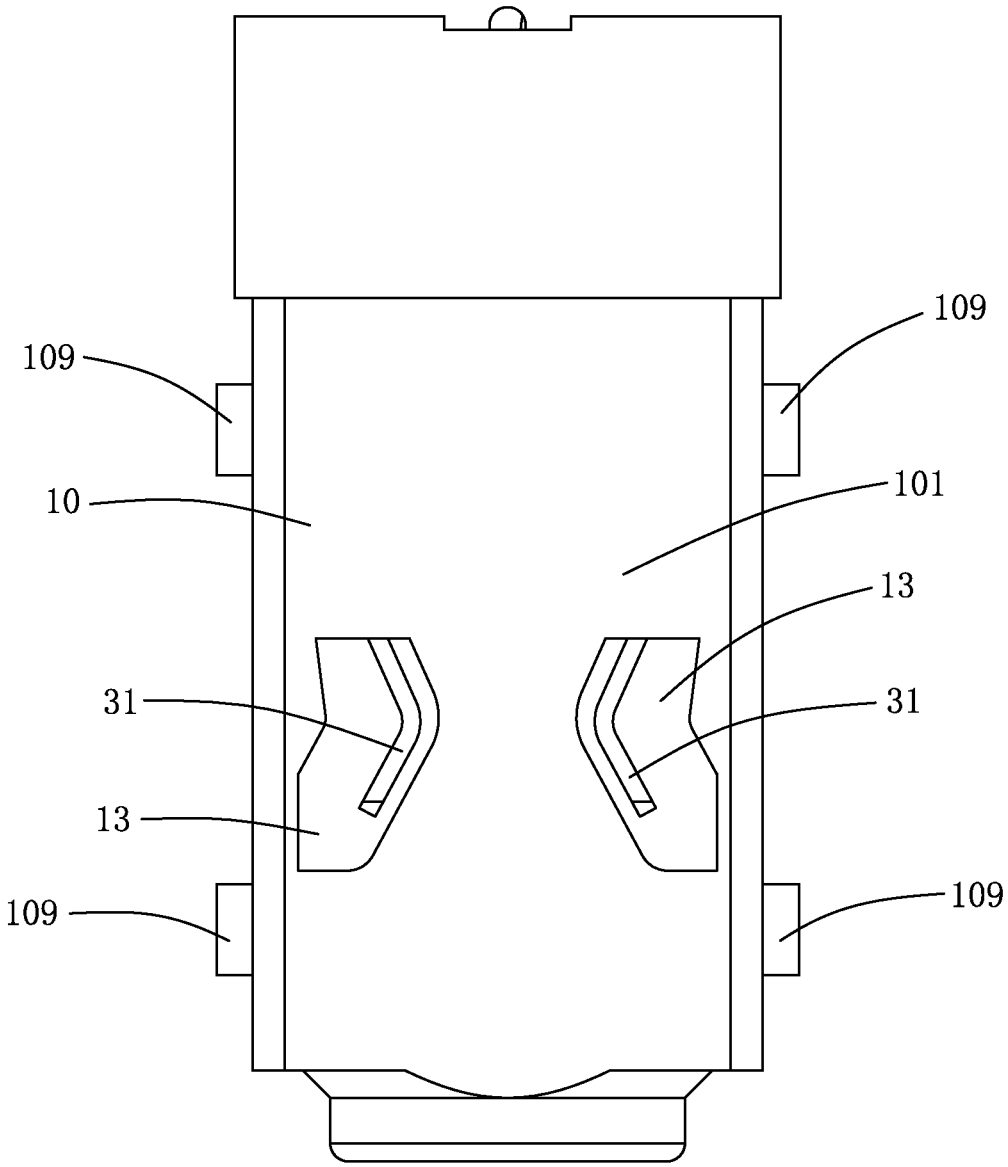
FIG. 7 is a top view of the insulating housing with contacts received therein.
Figure 10:
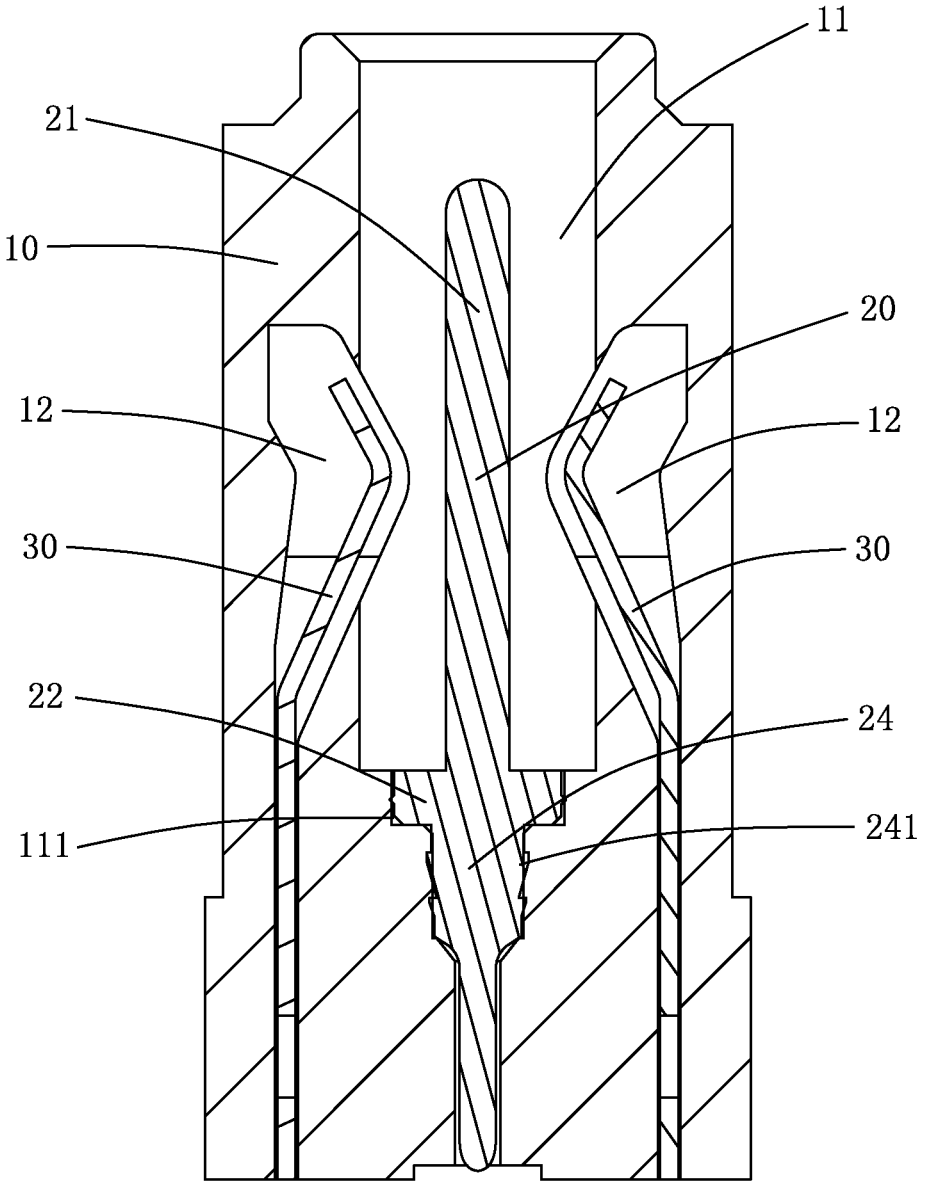
FIG. 10 is a cross-sectional view of the insulating housing with contacts received therein.
Figure 11:
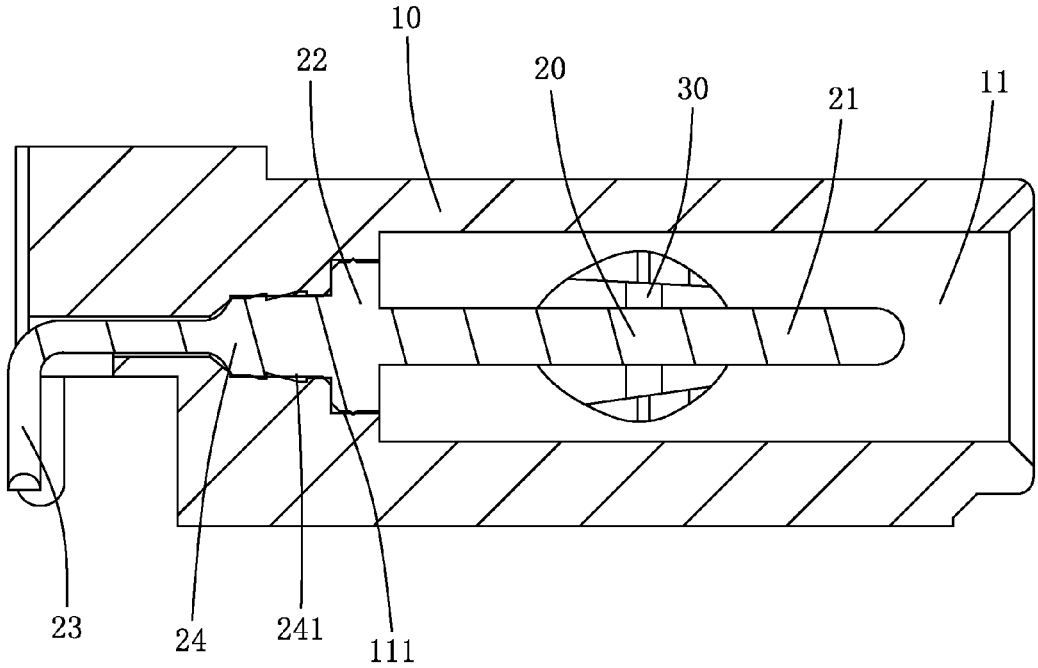
FIG. 11 is another cross-sectional view of the insulating housing with contacts received therein.
Figure 12:
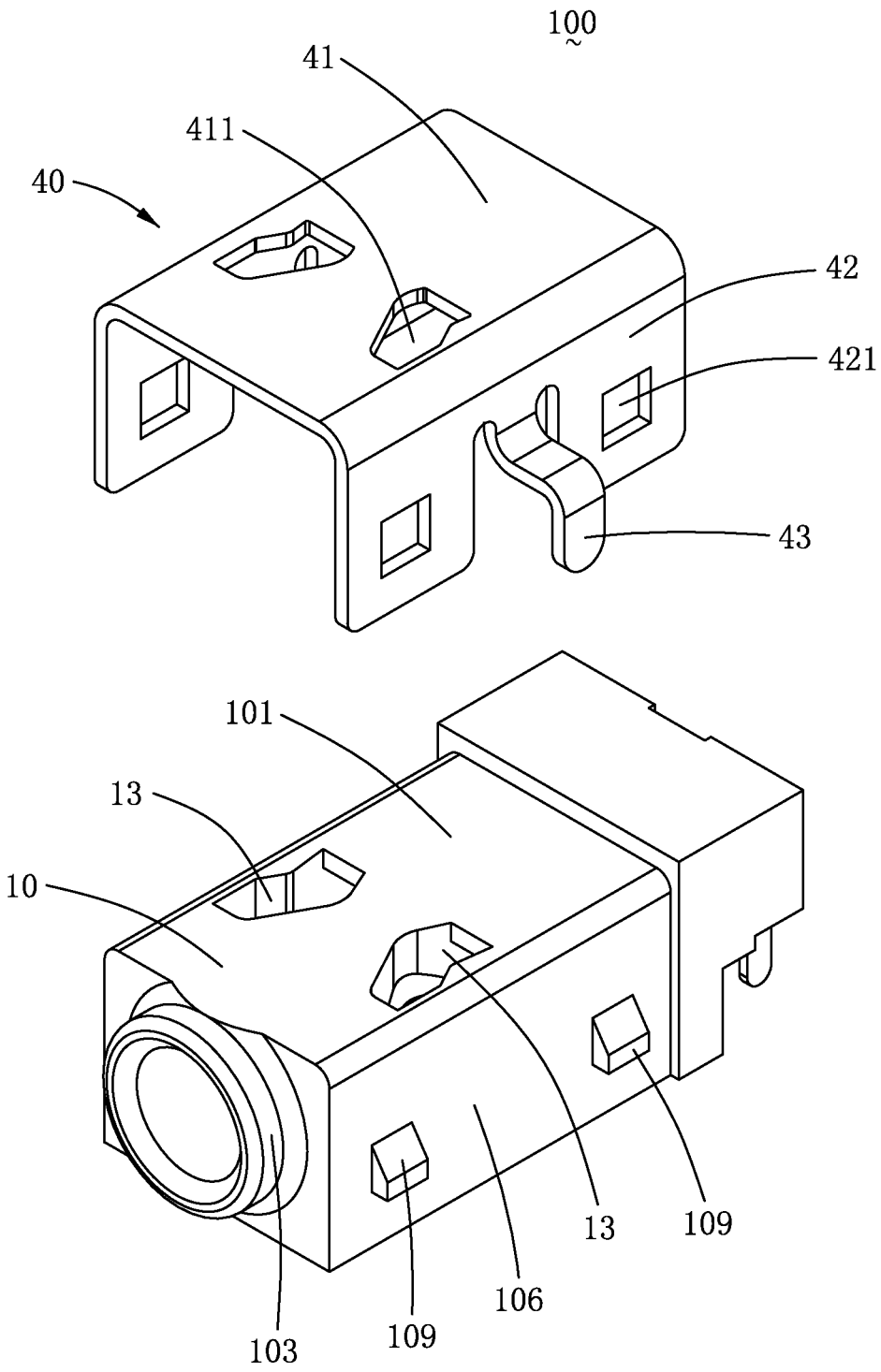
FIG. 12 is a partially exporded, perspective view of the power connector.
Figure 13:
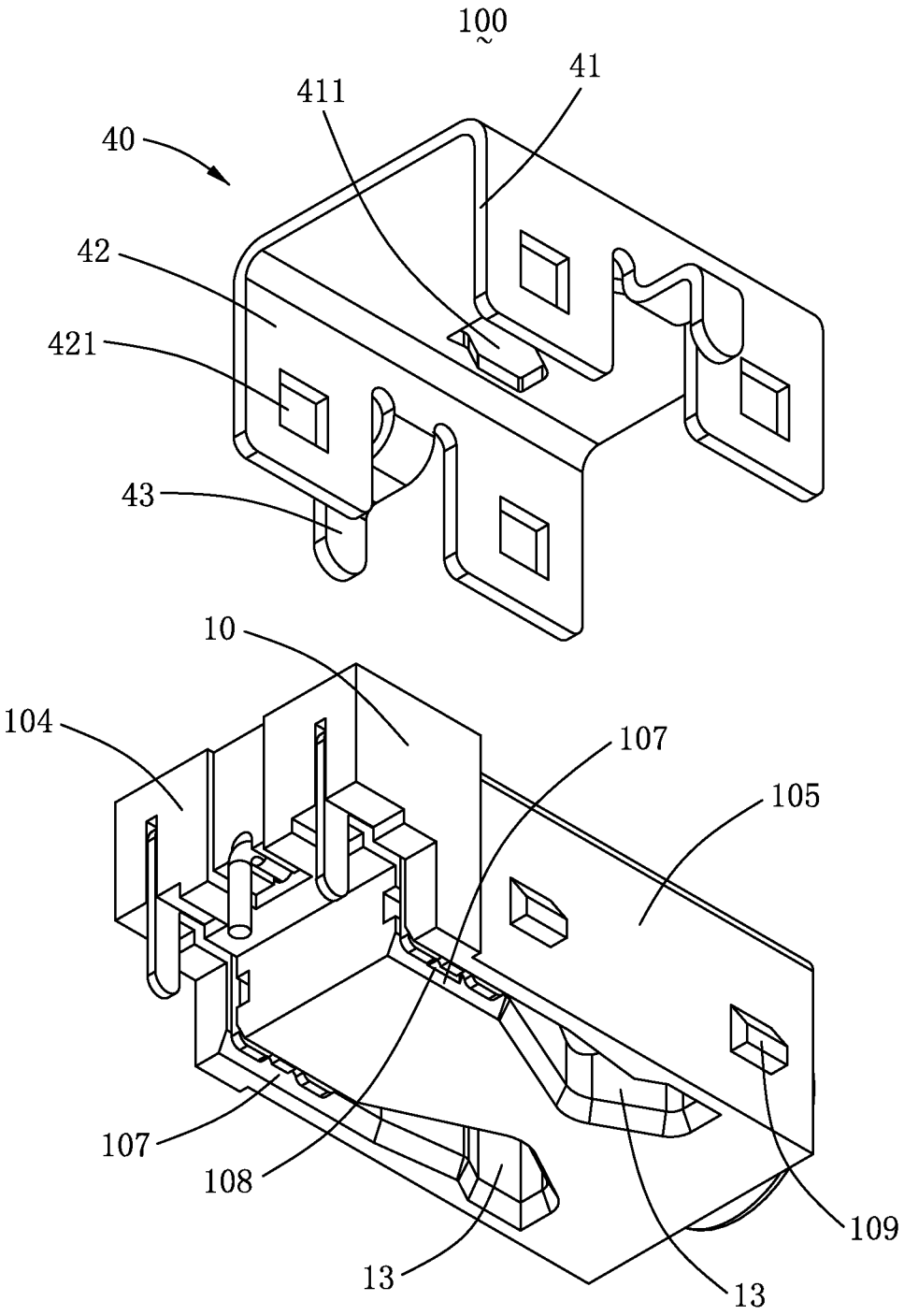
FIG. 13 is a view similar to FIG. 12.

Referring to FIGS. 2-4 together with FIGS. 10 and 11, the conductive pin 20 comprises a pillar-shaped contacting head 21 for electrically mating with a complementary connector (not shown), a first retaining section 22, a second retaining section 24 and a tail section 23. The first retaining section 22 has a larger size than that of the second retaining section 24. The tail section 23 extends out of the bottom wall 102 for mounting to the circuit board. The central channel 11 forms a step portion 111 therein and the first retaining section 22 engages with the step portion 111 to thereby limit the rearwards displacement of the conductive pin 20. The second retaining section 24 has a plurality of barbs 241 formed thereon for interfering with the insulating housing 10.

As shown in FIGS. 2-4, FIG. 6 and FIGS. 9-11, each spring contact 30 comprises a resilient contacting portion 31 received in corresponding passageway 12, a retaining portion 32, and a mounting portion 33 extending out of the bottom wall 102 for assembling to the circuit board. The pair of resilient contacting portions 31 are exposed to the air from corresponding heat dissipation cavity 13. The retaining portion 32 has a retaining pad 321 locking with the locking protrusion 108 of the receiving slot 107 to thereby secure the spring contact 30 in the insulating housing 10. The resilient contacting portion 31 is configured in a curved shape. The heat dissipation cavity 13 has substantially similar shape with that of the resilient contacting portion 31 in order to improve the effect of the heat dissipation. The two resilient contacting portions 31 are symmetrically arranged with respect to the pillar-shaped contacting head 21 of the conductive pin 20.

Figure 8:
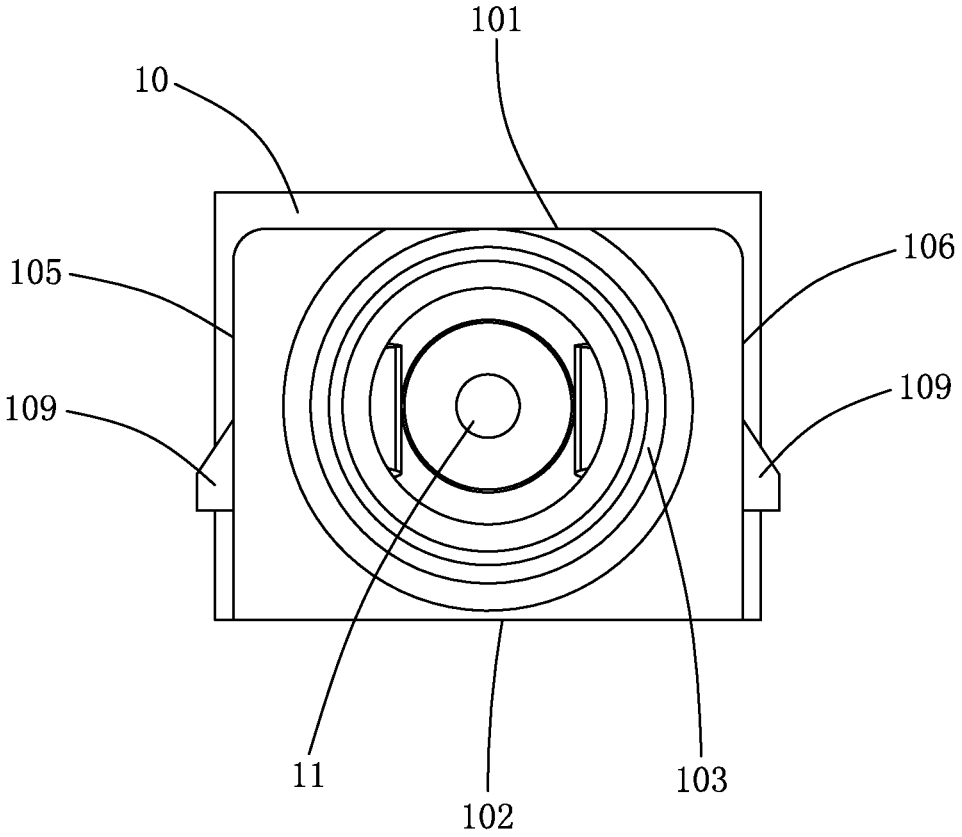
FIG. 8 is a front view of the insulating housing with contacts received therein.
Figure 9:
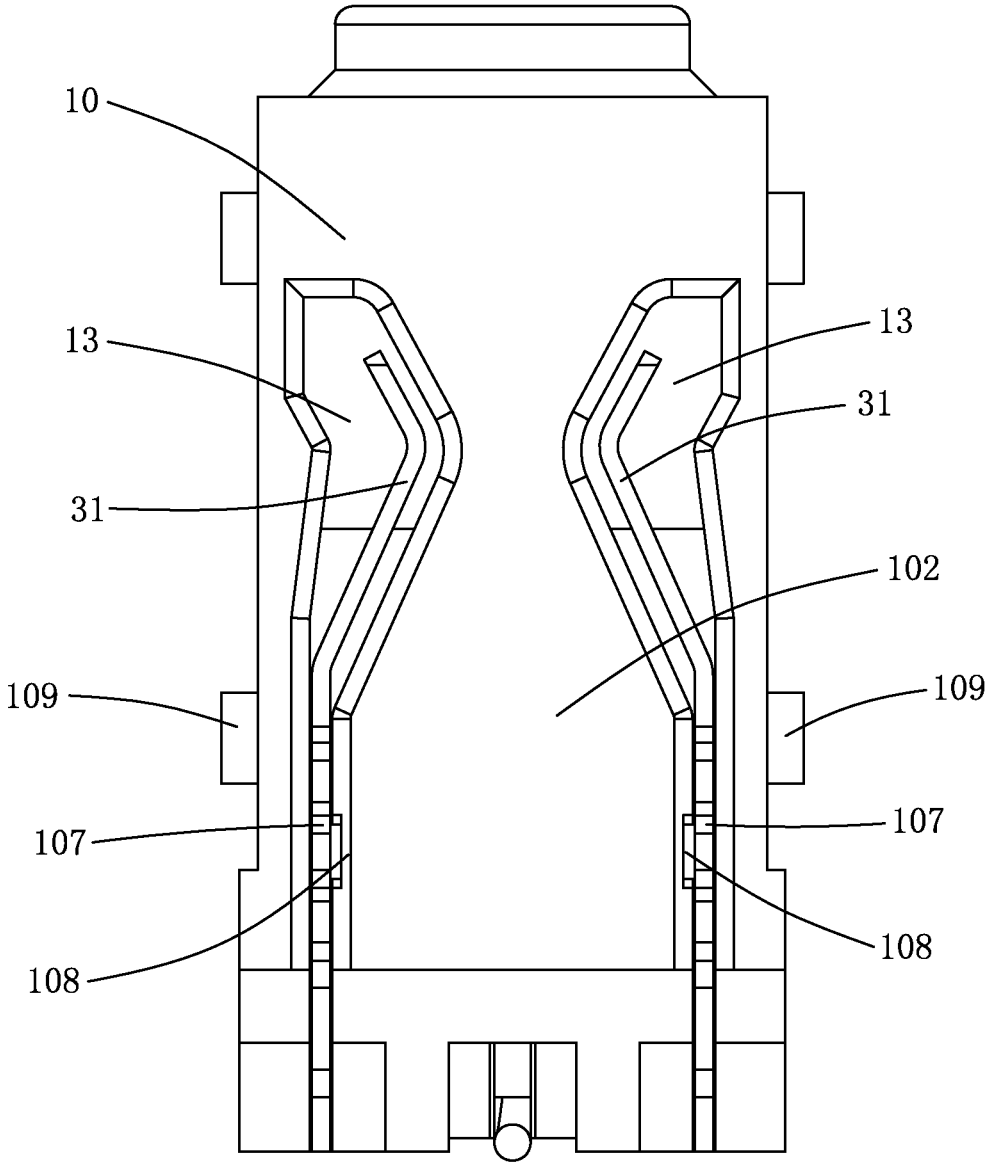
FIG. 9 is a bottom view of the insulating housing with contacts received therein.

Together referring to FIGS. 2-3 and 8, the metal shell 40 comprises an upper wall 41, a pair of side walls 42 extending perpendicularly from opposite sides of the upper wall 41, and a pair of mounting ends 43 extending from respectively from the side walls 42. The side wall 42 defines a pair of locking holes 421 for receiving the locking protrusions 109 of the side walls 105, 106 of the insulating housing to thereby secure the metal shell 40 with the insulating housing 10. The metal shell 40 defines heat dissipation hole 411 corresponding to and communicating with the heat dissipation cavities 13 of the insulating housing.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector mountable on a circuit board, comprising:

an insulating housing defining a central channel extending therethrough along a lengthwise direction thereof, and at least one passageway positioned besides and communicating with the central channel, the insulating housing having at least one heat dissipation cavity extending through the insulating housing along a longitudinal direction of the insulating housing, and wherein the insulating housing comprises a top wall and a bottom wall opposite to the top wall, and wherein the at least one heat dissipation cavity is opened from the top wall and the bottom wall;

a conductive pin received in the central channel; and at least one spring contact received in corresponding passageway.

2. The power connector as claimed in claim 1, wherein the at least one heat dissipation cavity communicates with the passageway.

3. The power connector as claimed in claim 2, wherein it is a pair of spring contacts employed in the power connector, and wherein the pair of spring contacts symmetrically arranged at opposite sides of the conductive pin.

4. The power connector as claimed in claim 3, wherein it is a pair of passageways defined in the insulating housing for receiving corresponding spring contacts.

5. The power connector as claimed in claim 3, wherein the pair of spring contacts each have a resilient contacting portion received in corresponding passageway and a retaining portion connecting with the resilient contacting portion for retaining the spring contact in the insulating housing.

6. The power connector as claimed in claim 5, wherein the resilient contacting portion of the spring contact is exposed to the at least one heat dissipation cavity.

7. The power connector as claimed in claim 3, wherein the insulating housing defines a receiving slot slotted on the bottom wall from which the spring contact is inserted into the insulating housing, and wherein the receiving slot communicates with the at least one heat dissipation cavity.

8. The power connector as claimed in claim 7, wherein the receiving slot provides a fastening protrusion therewith and wherein the spring contact comprises a retaining portion having a retaining pad engaged with the fastening protrusion.

9. The power connector as claimed in claim 7, wherein the insulating housing comprises a mating face connecting the top wall and the bottom wall and a rear face opposite to the mating face.

10. The power connector as claimed in claim 9, wherein the receiving slot extends rearwards and opens at the rear face of the insulating housing.

11. The power connector as claimed in claim 1, further comprising a metal shell covering the insulating housing.

12. The power connector as claimed in claim 11, wherein the metal shell defines at least one hole communicating with the at least one heat dissipation cavity of the insulating housing.

13. The power connector as claimed in claim 12, wherein the insulating housing comprises a pair of side walls each with a locking protrusion formed thereon.

14. The power connector as claimed in claim 13, wherein the metal shell defines a pair of locking holes engaging with the locking protrusions.

15. The power connector as claimed in claim 5, wherein the conductive pin comprises a pillar-shaped contacting head and a retaining section for securing the conductive pin in the insulating housing.

16. The power connector as claimed in claim 15, wherein the resilient contacting portion of the spring contact is exposed to the air from the at least one heat dissipation cavity.

17. The power connector as claimed in claim 16, wherein the resilient contacting portion of the spring contact is configured in a curved shape.

18. The power connector as claimed in claim 17, wherein the resilient contacting portions of the spring contacts are symmetrically arranged with respect to the conductive pin.

* * * * *